US010696360B2

(12) United States Patent
Balasubramanian et al.

(10) Patent No.: US 10,696,360 B2
(45) Date of Patent: Jun. 30, 2020

(54) SHIP/FLOATING STORAGE UNIT WITH DUAL CRYOGENIC CARGO TANK FOR LNG AND LIQUID NITROGEN

(71) Applicants: Sathish Balasubramanian, The Woodlands, TX (US); Austin Blackert, Houston, TX (US)

(72) Inventors: Sathish Balasubramanian, The Woodlands, TX (US); Austin Blackert, Houston, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 76 days.

(21) Appl. No.: 15/895,627

(22) Filed: Feb. 13, 2018

(65) Prior Publication Data

US 2018/0281905 A1 Oct. 4, 2018

Related U.S. Application Data

(60) Provisional application No. 62/478,961, filed on Mar. 30, 2017.

(51) Int. Cl.
*B63B 25/12* (2006.01)
*B63B 11/02* (2006.01)
(Continued)

(52) U.S. Cl.
CPC ..... *B63B 25/12* (2013.01); *B63B 11/02* (2013.01); *F17C 6/00* (2013.01); *F17C 9/02* (2013.01);
(Continued)

(58) Field of Classification Search
CPC . B63B 25/12; B63B 11/02; F17C 6/00; F17C 6/02; F17C 13/082
See application file for complete search history.

(56) References Cited

U.S. PATENT DOCUMENTS 7,028,489 B1 * 4/2006 Hall, IV ..... F17C 6/00 137/563
8,079,321 B2 12/2011 Balasubramanian ..... 114/74 R
(Continued)

FOREIGN PATENT DOCUMENTS

| | | | |
|---|---|---|---|
| EP | 2157013 | 2/2010 | B63B 25/16 |
| EP | 2157013 A1 * | 2/2010 | B63B 25/16 |
| WO | WO2008/133785 | 11/2008 | B63B 25/08 |
| WO | WO2011/101461 | 8/2011 | B63B 25/16 |
| WO | WO-2011101461 A1 * | 8/2011 | B63B 25/16 |

OTHER PUBLICATIONS

Bach, Wilfried (1990) "Offshore Erdgasverflussigung mit Stickstoffkalte—ProseBauslegung und Vergleich von Gewickelten Rohr- und Plattenwarmetauschern," *Berichte aus Technik und Wissenschaft, Linde Ag.* Wiesbaden, DE, No. 64, pp. 31-17, XP000114322, ISSN: 0942-332X.

U.S. Appl. No. 15/873,624, filed Jan. 17, 2018, Kaminsky, Robert D. et al.

*Primary Examiner* — S. Joseph Morano
*Assistant Examiner* — Jovon E Hayes
(74) *Attorney, Agent, or Firm* — ExxonMobil Upstream Research Company

(57) ABSTRACT

A water-borne carrier for transporting liquefied natural gas (LNG) and liquefied nitrogen (LIN). A plurality of dual-purpose cryogenic storage tanks are arranged along a length of the ship. The plurality of dual-purpose cryogenic storage tanks may contain LNG or LIN. A LNG-only cryogenic storage tank may be arranged along the length of the ship. The LNG-only cryogenic storage tank contains only LNG.

23 Claims, 4 Drawing Sheets

(51) Int. Cl.

| | |
|---|---|
| ***F17C 13/08*** | (2006.01) |
| ***F17C 9/02*** | (2006.01) |
| ***F17C 6/00*** | (2006.01) |
| *B63B 13/02* | (2006.01) |

(52) U.S. Cl.

CPC ..... *F17C 13/082* (2013.01); *B63B 13/02* (2013.01); *F17C 2201/0166* (2013.01); *F17C 2201/052* (2013.01); *F17C 2205/013* (2013.01); *F17C 2205/0134* (2013.01); *F17C 2205/0157* (2013.01); *F17C 2221/014* (2013.01); *F17C 2221/033* (2013.01); *F17C 2223/0161* (2013.01); *F17C 2223/033* (2013.01); *F17C 2225/0161* (2013.01); *F17C 2225/033* (2013.01); *F17C 2227/04* (2013.01); *F17C 2227/044* (2013.01); *F17C 2260/021* (2013.01); *F17C 2260/025* (2013.01); *F17C 2265/05* (2013.01); *F17C 2270/0105* (2013.01); *F17C 2270/0113* (2013.01)

(56) References Cited

U.S. PATENT DOCUMENTS

| | | | | |
|---|---|---|---|---|
| 2009/0218354 | A1* | 9/2009 | Yoo | F17C 3/00 220/560.11 |
| 2010/0192626 | A1 | 8/2010 | Chantant | 62/606 |
| 2010/0251763 | A1 | 10/2010 | Audun | 62/614 |
| 2015/0316208 | A1* | 11/2015 | Bae | F25J 1/0042 62/53.2 |
| 2017/0167785 | A1* | 6/2017 | Pierre, Jr. | F25J 1/0015 |
| 2017/0167787 | A1* | 6/2017 | Pierre, Jr. | F25J 1/0278 |
| 2018/0245740 | A1* | 8/2018 | Kaminsky | F17C 5/02 |
| 2018/0281905 | A1* | 10/2018 | Balasubramanian | B63B 25/12 |

* cited by examiner

SHIP/FLOATING STORAGE UNIT WITH DUAL CRYOGENIC CARGO TANK FOR LNG AND LIQUID NITROGEN

CROSS-REFERENCE TO RELATED APPLICATIONS

This application claims the priority benefit of U.S. Patent Application 62/478,961 filed Mar. 30, 2017 entitled SHIP/FLOATING STORAGE UNIT WITH DUAL CRYOGENIC CARGO TANK FOR LNG AND LIQUID NITROGEN, the entirety of which is incorporated by reference herein.

BACKGROUND

Field of Disclosure

The disclosure relates generally to the field of natural gas liquefaction to form liquefied natural gas (LNG). More specifically, the disclosure relates to the production and transfer of LNG from offshore and/or remote sources of natural gas.

Description of Related Art

This section is intended to introduce various aspects of the art, which may be associated with the present disclosure. This discussion is intended to provide a framework to facilitate a better understanding of particular aspects of the present disclosure. Accordingly, it should be understood that this section should be read in this light, and not necessarily as an admission of prior art.

LNG is a rapidly growing means to supply natural gas from locations with an abundant supply of natural gas to distant locations with a strong demand for natural gas. The conventional LNG cycle includes: a) initial treatments of the natural gas resource to remove contaminants such as water, sulfur compounds and carbon dioxide; b) the separation of some heavier hydrocarbon gases, such as propane, butane, pentane, etc. by a variety of possible methods including self-refrigeration, external refrigeration, lean oil, etc.; c) refrigeration of the natural gas substantially by external refrigeration to form liquefied natural gas at or near atmospheric pressure and about −160° C.; d) transport of the LNG product in ships or tankers designed for this purpose to a market location; and e) re-pressurization and regasification of the LNG at a regasification plant to a pressurized natural gas that may distributed to natural gas consumers. Step (c) of the conventional LNG cycle usually requires the use of large refrigeration compressors often powered by large gas turbine drivers that emit substantial carbon and other emissions. Large capital investments in the billions of US dollars and extensive infrastructure are required as part of the liquefaction plant. Step (e) of the conventional LNG cycle generally includes re-pressurizing the LNG to the required pressure using cryogenic pumps and then re-gasifying the LNG to pressurized natural gas by exchanging heat through an intermediate fluid but ultimately with seawater or by combusting a portion of the natural gas to heat and vaporize the LNG. Generally, the available energy of the cryogenic LNG is not utilized.

It has been proposed to modify steps (c) and (e) of the conventional LNG cycle by liquefying natural gas using liquid nitrogen (LIN) as the coolant, and using the energy of the cryogenic LNG to facilitate the liquefaction of nitrogen gas to form LIN that may then be transported to the resource location and used as a source of refrigeration for the production of LNG. This LIN-to-LNG concept may further include the transport of LNG in a ship or tanker from the resource location (export terminal) to the market location (import terminal) and the reverse transport of LIN from the market location to the resource location. The LIN-to-LNG concept may further include transporting the LIN and LNG in dual-use carriers having one or more cryogenic storage tanks designed to transport LIN to an LNG liquefaction location and to transport LNG to an LNG regasification location. These concepts are disclosed in commonly owned U.S. patent application Ser. No. 15/348,004, titled "Method of Natural Gas Liquefaction on LNG Carriers Storing Liquid Nitrogen," filed Nov. 10, 2016, the disclosure of which is incorporated by reference herein in its entirety. The LIN-to-LNG concept was disclosed as being beneficial when LNG liquefaction was to take place on a liquefaction vessel receiving natural gas from a floating production unit, but the concept may be used with onshore LNG liquefaction facilities as well.

The storage tanks in known dual purpose carriers are distributed bow-to-stern. What is needed is a dual purpose LIN/LNG carrier that will sail with a constant and level draught regardless of the type and amount of LNG and/or LIN aboard.

SUMMARY

The present disclosure provides a water-borne carrier for transporting liquefied natural gas (LNG) and liquefied nitrogen (LIN). A plurality of dual-purpose cryogenic storage tanks are arranged along a length of the ship. The plurality of dual-purpose cryogenic storage tanks may contain LNG or LIN. A LNG-only cryogenic storage tank may be arranged along the length of the ship. The LNG-only cryogenic storage tank contains only LNG.

The present disclosure also provides a method of transporting liquefied natural gas (LNG) and liquefied nitrogen (LIN) in a water-borne carrier. At a first location, LIN is emptied from a plurality of dual-purpose cryogenic storage tanks that are positioned along a length of the carrier. At the first location, the plurality of dual-purpose cryogenic storage tanks and an additional cryogenic storage tank are filled with LNG. The additional storage tank is positioned along the length of the carrier parallel to the plurality of dual-purpose cryogenic storage tanks. Using the carrier, the LNG is transported to a second location, where the LNG is emptied from the plurality of dual-purpose cryogenic storage tanks and the additional cryogenic storage tank. The plurality of dual-purpose cryogenic storage tanks are filled with LIN at the second location. The LIN is transported to the first location using the carrier.

The present disclosure further provides a method of transporting liquefied natural gas (LNG) and liquefied nitrogen (LIN) in a water-borne carrier. At a first location, LIN is emptied from a plurality of dual-purpose cryogenic storage tanks that are positioned along a length of the carrier. At the first location, the plurality of dual-purpose cryogenic storage tanks and a LNG-only cryogenic storage tank are filled with LNG. The LNG-only cryogenic storage tank is positioned along the length of the carrier between the plurality of dual-purpose cryogenic storage tanks. Using the carrier, the LNG is transported to a second location, where the LNG is emptied from the plurality of dual-purpose cryogenic storage tanks and the LNG-only cryogenic storage tank. The plurality of dual-purpose cryogenic storage tanks are filled with LIN at the second location. The LIN is transported to the first location using the carrier. At the first location and/or the second location, a load balance of the carrier is maintained while emptying and filling the plurality of dual-purpose cryogenic storage tanks and the LNG-only cryogenic storage tank. The plurality of dual-purpose cryogenic storage tanks are emptied of LNG before emptying LNG from the LNG-only cryogenic storage tank at the second location. The plurality of dual-purpose cryogenic storage tanks are filled with LIN while emptying LNG from the LNG-only cryogenic storage tank at the second location. The LNG-only cryogenic storage tank is filled with LNG while emptying LIN from the plurality of dual-purpose cryogenic storage tanks at the first location.

The foregoing has broadly outlined the features of the present disclosure so that the detailed description that follows may be better understood. Additional features will also be described herein.

BRIEF DESCRIPTION OF THE DRAWINGS

These and other features, aspects and advantages of the disclosure will become apparent from the following description, appending claims and the accompanying drawings, which are briefly described below.

Figure 1A:
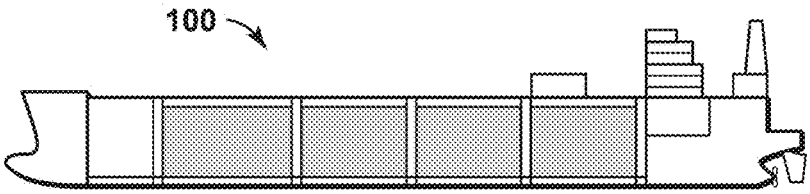
FIGS. 1A, 1B, and 1C are side top, and end cutaway views of a ship according to aspects of the disclosure.

It should be noted that the figures are merely examples and no limitations on the scope of the present disclosure are intended thereby. Further, the figures are generally not drawn to scale, but are drafted for purposes of convenience and clarity in illustrating various aspects of the disclosure.

DETAILED DESCRIPTION

To promote an understanding of the principles of the disclosure, reference will now be made to the features illustrated in the drawings and specific language will be used to describe the same. It will nevertheless be understood that no limitation of the scope of the disclosure is thereby intended. Any alterations and further modifications, and any further applications of the principles of the disclosure as described herein are contemplated as would normally occur to one skilled in the art to which the disclosure relates. For the sake clarity, some features not relevant to the present disclosure may not be shown in the drawings.

At the outset, for ease of reference, certain terms used in this application and their meanings as used in this context are set forth. To the extent a term used herein is not defined below, it should be given the broadest definition persons in the pertinent art have given that term as reflected in at least one printed publication or issued patent. Further, the present techniques are not limited by the usage of the terms shown below, as all equivalents, synonyms, new developments, and terms or techniques that serve the same or a similar purpose are considered to be within the scope of the present claims.

As one of ordinary skill would appreciate, different persons may refer to the same feature or component by different names. This document does not intend to distinguish between components or features that differ in name only. The figures are not necessarily to scale. Certain features and components herein may be shown exaggerated in scale or in schematic form and some details of conventional elements may not be shown in the interest of clarity and conciseness. When referring to the figures described herein, the same reference numerals may be referenced in multiple figures for the sake of simplicity. In the following description and in the claims, the terms "including" and "comprising" are used in an open-ended fashion, and thus, should be interpreted to mean "including, but not limited to."

The articles "the," "a" and "an" are not necessarily limited to mean only one, but rather are inclusive and open ended so as to include, optionally, multiple such elements.

As used herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numeral ranges provided. Accordingly, these terms should be interpreted as indicating that insubstantial or inconsequential modifications or alterations of the subject matter described and are considered to be within the scope of the disclosure.

"Exemplary" is used exclusively herein to mean "serving as an example, instance, or illustration." Any embodiment or aspect described herein as "exemplary" is not to be construed as preferred or advantageous over other embodiments.

The term "dual purpose carrier" refers to a ship capable of storing and/or transporting LIN and/or LNG.

The disclosure describes a water-borne carrier or ship design with cryogenic storage tanks and equipment that allow for the safe storage, loading and offloading of LNG and LIN). The carrier is envisioned to have multiple storage compartments or cargo tanks with transverse and/or longitudinal subdivisions. Some or all of the cargo tanks may be designed to carry LNG and LIN at different times. The cargo tanks are designed to meet industry standards for fluid loads, temperature and pressure limits for cryogenic cargoes and feature systems to limit and handle boil-off to a certain value. Dedicated piping and transfer systems for LIN and LNG are included.

Figure 1B:
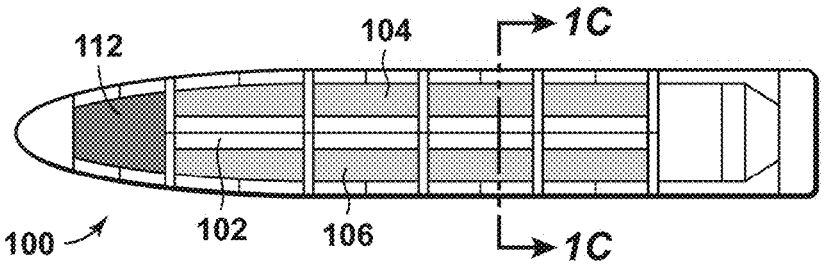
Figure 1C:
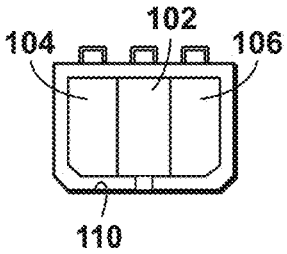

FIGS. 1A, 1B, and 1C are side, top, and cutaway end views, respectively, of a water-borne carrier, vessel, barge, or ship 100, according to aspects of the present disclosure. Ship 100 may include an LNG-only cryogenic tank 102 disposed in a direction parallel to a length of the ship. In an aspect, the LNG-only cryogenic tank 102 may be disposed along a center axis of the ship. The ship also includes first and second dual-purpose cryogenic tanks 104, 106 disposed along either side of the LNG-only cryogenic tank 102. Each of tanks 102, 104, 106 may be constructed as a single tank with or without baffles, which subdivide each tank to minimize loads from sloshing during ship movement. An example of such tanks may be found in commonly-owned U.S. Pat. No. 8,079,321, titled "Long Tank FSRU/FLSV/LNGC," the disclosure of which is incorporated by reference herein in its entirety. Alternatively, each of tanks 102, 104, 106 may comprise a series of smaller tanks running along the length of the ship.

The ship 100 includes refrigeration components that, along with the construction of the tanks 102, 104, 106, keep the contents in a cryogenic state. Specifically, the LNG-only cryogenic tank 102, which transports only LNG, is constructed to maintain its contents at or below the LNG boiling point (i.e., −162° C.) but not necessarily below the boiling point of nitrogen (−196° C.). In contrast, the dual-purpose cryogenic tanks 104, 106 can hold either LNG or LIN, so these tanks are constructed to maintain their contents at or below the boiling point of nitrogen if LIN is being contained therein, but only at or below the boiling point of LNG if LNG is being held therein. It is not necessary to maintain the LNG below the boiling point of LIN.

Figure 3A:
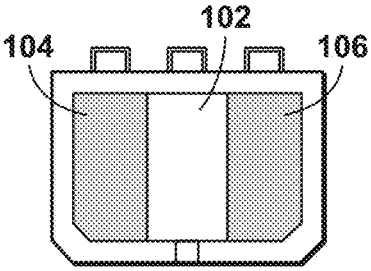
FIGS. 3A, 3B, and 3C are end cutaway views of a ship according to disclosed aspects.
Figure 3B:
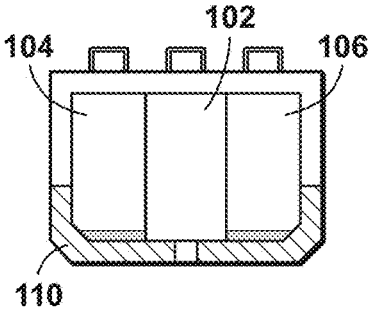
Figure 3C:
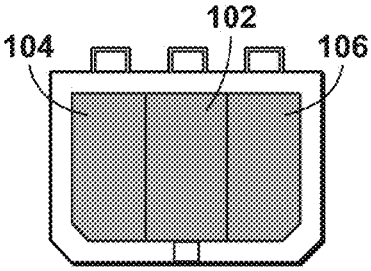
Figure 2:
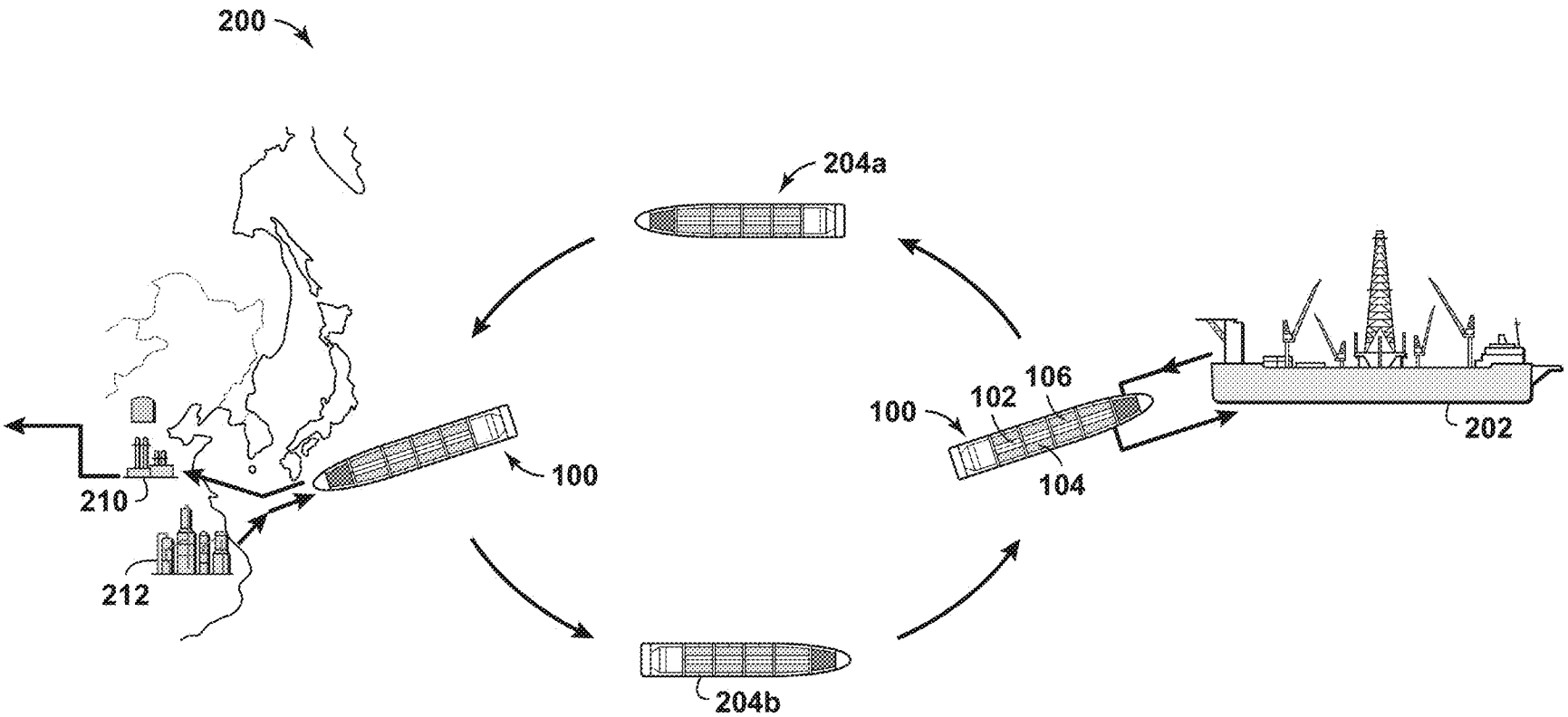
FIG. 2 is a simplified schematic diagram showing a method according to disclosed aspects.

In an aspect, ship 100 is designed to transport LIN to a first location, which may be an LNG liquefaction location. At the first location, the LIN may be used as a coolant to liquefy natural gas. The ship may then be used to transport LNG from the first location to a second location, which may be a regasification location where the LNG is regasified. FIG. 2 is a schematic diagram of an exemplary method according to disclosed aspects. The diagram shows ship 100 at various steps in an LNG transportation and delivery cycle 200. The ship 100, with the first and second dual-purpose cryogenic tanks 104, 106 containing LIN and the LNG-only cryogenic tank 102 being empty as shown in FIG. 3A, arrives at a first location 202, which may be a land-based facility, a floating production and storage unit (FPSU), or any other onshore/offshore facility relating to the production of natural gas, liquefaction of natural gas, and/or the storage of LNG. At the first location 202, the first and second dual-purpose cryogenic tanks are emptied of LIN. The LIN may be used to liquefy natural gas to form LNG, or may be used for other purposes. As the first and second dual-purpose cryogenic tanks 104, 106 are emptied of LIN, LNG may be pumped into the LNG-only cryogenic tank 102. LNG may also be pumped into the first and second dual-purpose cryogenic tanks 104, 106 when all or substantially all of the LIN has been emptied therefrom. As shown in FIG. 3B, ballast in the form of seawater may be introduced into ballast tanks 110 to maintain or substantially maintain the ship at a suitable draught when the ship has less than a full load of LIN and/or LNG. In an aspect of the disclosure, tanks 102, 104, 106 are designed to be filled to a similar level of LNG during transport, storage, and filling operations, to ensure the ship is carrying a balanced load front-to-back and side-to-side, as shown in FIG. 3C. When the ship is filled to the desired LNG capacity, the ship transports the LNG, as shown at 204*a*, to a second location, which in an aspect may be at or near an LNG regasification facility 210 and/or a LIN production facility such as an air separation unit 212. The LNG is then unloaded from tanks 102, 104, 106. In a preferred aspect, LNG from the first and second dual-purpose cryogenic tanks 104, 106 is first removed, and then LNG from the LNG-only cryogenic tank 102 is removed. The cold energy from the LNG, extracted during regasification of the LNG, may be used to assist in the liquefaction of nitrogen to form LIN at the air separation unit 212. Once emptied or substantially emptied of LNG, the first and second dual-purpose cryogenic tanks may be purged to remove any remaining LNG. The purging may be accomplished using any known method, such as the method disclosed in commonly-owned U.S. Provisional Patent Application No. 62/463,274, filed Feb. 24, 2017 and titled "Method of Purging a Dual Purpose LNG/LIN Storage Tank," the disclosure of which is incorporated by reference herein in its entirety. The first and second dual-purpose cryogenic tanks 104, 106 may then be filled with LIN while the LNG-only cryogenic tank 102 is being emptied. The LIN is loaded into the ship in a manner that ensures a proper load balance as previously discussed. The ship, laden with LIN, now returns (as shown at 204*b*) to the first location 202 to repeat the cycle 200.

Figure 4:
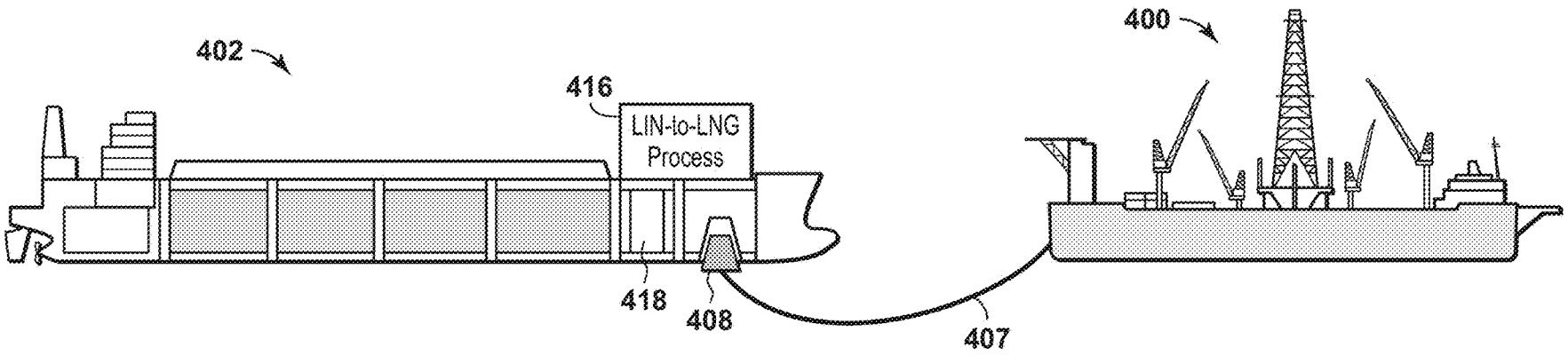
FIG. 4 is a simplified schematic diagram showing a ship according to another disclosed aspect.

According to other aspects of the disclosure, LNG liquefaction equipment may be disposed onboard ship 100. FIG. 4 depicts a floating production unit (FPU) 400 and liquefaction vessel 402 according to such a disclosed aspect. Natural gas may be produced and treated on the FPU 400. The FPU 400 may contain gas processing equipment to remove impurities, if present, from the natural gas, to make the produced natural gas suitable for liquefaction and/or marketing. Such impurities may include water, heavy hydrocarbons, sour gases, and the like. The FPU may also contain one or more pre-cooling means to pre-cool the treated natural gas prior to being transported to the liquefaction vessel. The pre-cooling means may comprise deep sea-water retrieval and cooling, mechanical refrigeration, or other known technologies. The pre-cooled treated natural gas may be transported from the FPU 400 to a liquefaction vessel via a pipeline or other flexible connection 407 and one or more moored floating disconnectable turrets 408 which can be connected and reconnected to one or more liquefaction vessels. As with ship 100, the liquefaction vessel 402 may include first and second dual-purpose cryogenic tanks that may hold LNG or LIN, and an LNG-only cryogenic tank that may only hold LNG. (These tanks are described with respect to previous Figures, and for the sake of brevity will not be described again.) The pre-cooled treated natural gas may be liquefied on the liquefaction vessel using equipment in a LIN-to-LNG process module 416, which may include at least one heat exchanger that exchanges heat between a LIN stream (from the LIN stored on the liquefaction vessel) and the pre-cooled treated natural gas stream, to at least partially vaporize the LIN stream and at least partially condense the pre-cooled treated natural gas stream to form LNG. An example of a suitable LIN-to-LNG process module is disclosed in commonly-owned U.S. patent application Ser. No. 15/348,004, filed Nov. 10, 2016 and titled "Method of Natural Gas Liquefaction on LNG Carriers Storing Liquid Nitrogen," the disclosure of which is incorporated by reference herein in its entirety. The liquefaction vessel 402 may also comprise additional utility systems 418 associated with the liquefaction process. The utility systems 418 may be located within the hull of the liquefaction vessel 402 and/or on the topside of the vessel. The LNG produced by the LIN-to-LNG process module 416 may be stored either in the LNG-only cryogenic tank or in the first or second dual-purpose cryogenic tank as previously described. Since the LNG is produced on the liquefaction vessel, which also serves as a transportation vessel, over-water transfer of LNG at the production site is eliminated. As previously disclosed herein, it is anticipated that the first and second dual-purpose cryogenic tanks and the LNG-only cryogenic tank comprise multiple LIN tanks, multiple LNG tanks, and multiple multi-purpose tanks, respectively.

The aspects disclosed in FIG. 4 have several advantages. First, the design of liquefaction vessel 402, based on ship 100, enables LNG production in remote onshore and offshore locations where the construction and/or maintenance of liquefaction facilities would be economically unfeasible. Additionally, the LIN and/or liquid nitrogen boil off gas may be used to keep the liquefaction equipment cold during turndown or shutdown of the liquefaction process. LIN may be used to liquefy vaporized nitrogen to produce an "idling-like" operation of the liquefaction process. Small helper motors may be attached to the compressor/expander combinations found in the expander services to keep the compressor/expander services spinning during turndown or shutdown of the liquefaction process. Nitrogen vapor may be used to de-rime the heat exchangers during the periods between LNG production on the liquefaction vessel. Additionally, any nitrogen vapor generated during LNG liquefaction may be vented to the atmosphere.

The disclosed aspects may be varied in many ways while keeping within the spirit and scope of the invention. For example, more than one LNG-only cryogenic tank may be used. One of such additional LNG-only tanks is shown in FIG. 1 by reference number 112, with the LNG contained therein used as a fuel for propulsion of the ship. The placement of the various tanks may be arranged according to ship stability considerations as well as to minimize loading/unloading times. The LIN on a first LNG/LIN ship or carrier may be used to liquefy the LNG to be transported by a second LNG carrier or LNG/LIN carrier, and the first LNG/LIN carrier may be loaded with LNG liquefied using LIN from a second and/or a third LNG/LIN carrier. Further, the ship 100 may be used as a floating storage unit or barge that stores LIN and/or LNG for an indeterminate time at either the first location or the second location, or even at another location. Additionally, the LNG-only cryogenic tank 102 may be replaced by a dual-purpose cryogenic tank that is capable of storing and transporting LNG and LIN. In such an arrangement, LNG and/or LIN may be loaded and/or unloaded on or off of ship 100 in any desirable sequence, and all such dual-purpose cryogenic tanks on the ship would need to be capable of maintaining their contents at below the boiling point of nitrogen as well as methane, depending on the contents of the tank at a given time.

Figure 5:
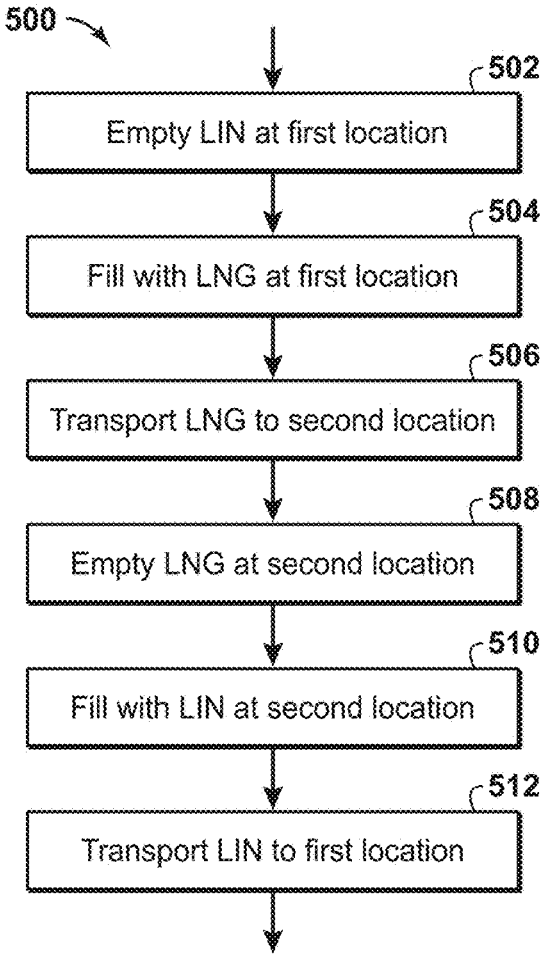
FIG. 5 is a flowchart of a method according to aspects of the disclosure.

FIG. 5 is a flowchart of a method 500 of transporting LNG and LIN in a water-borne carrier according to aspects of the disclosure. At block 502 LIN is emptied at a first location from a plurality of dual-purpose cryogenic storage tanks that are positioned along a length of the carrier. At block 504 the plurality of dual-purpose cryogenic storage tanks and an additional cryogenic storage tank are filled with LNG at the first location. The additional storage tank is positioned along the length of the carrier parallel to the plurality of dual-purpose cryogenic storage tanks. The additional cryogenic storage tank may be a dual-purpose cryogenic storage tank, or may be a LNG-only cryogenic storage tank in which only LNG, but not LIN, is configured to be stored and/or transported. At block 506 the LNG is transported to a second location. At block 508 the LNG is emptied from the plurality of dual-purpose cryogenic storage tanks and the additional cryogenic storage tank at a second location. At block 510 the plurality of dual-purpose cryogenic storage tanks are filled with LIN at the second location. At block 512 the LIN is transported to the first location using the carrier.

Figure 6:
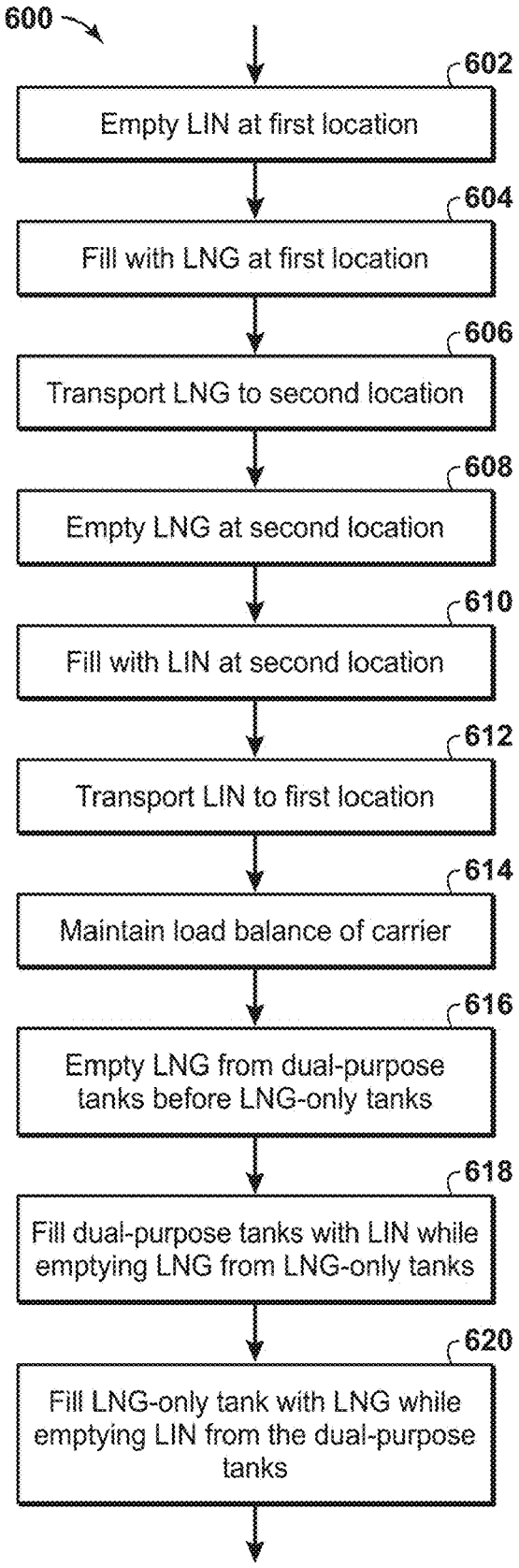
FIG. 6 is a flowchart of a method according to aspects of the disclosure.

FIG. 6 is a flowchart of a method 600 of transporting LNG and LIN in a water-borne carrier according to aspects of the disclosure. At block 602 LIN is emptied at a first location from a plurality of dual-purpose cryogenic storage tanks that are positioned along a length of the carrier. At block 604 the plurality of dual-purpose cryogenic storage tanks and a LNG-only cryogenic storage tank are filled with LNG at the first location. The LNG-only cryogenic storage tank is positioned along the length of the carrier between the plurality of dual-purpose cryogenic storage tanks. At block 606 the LNG is transported to a second location. At block 608 the LNG is emptied from the plurality of dual-purpose cryogenic storage tanks and the LNG-only cryogenic storage tank at a second location. At block 610 the plurality of dual-purpose cryogenic storage tanks are filled with LIN at the second location. At block 612 the LIN is transported to the first location using the carrier. At block 614 a load balance of the carrier is maintained at the first location and/or the second location while emptying and filling the plurality of dual-purpose cryogenic storage tanks and the LNG-only cryogenic storage tank. At block 616 the plurality of dual-purpose cryogenic storage tanks are emptied of LNG before emptying LNG from the LNG-only cryogenic storage tank at the second location. At block 618 the plurality of dual-purpose cryogenic storage tanks are filled with LIN while emptying LNG from the LNG-only cryogenic storage tank at the second location. At block 620 the LNG-only cryogenic storage tank is filled with LNG while emptying LIN from the plurality of dual-purpose cryogenic storage tanks at the first location.

The steps depicted in FIGS. 5 and 6 are provided for illustrative purposes only and a particular step may not be required to perform the disclosed methodology. Moreover, FIGS. 5 and 6 may not illustrate all the steps that may be performed. The claims, and only the claims, define the disclosed system and methodology.

The aspects described herein have several advantages over known technologies. For example, an advantage of the disclosed tank subdivision and arrangement is to maintain the sailing condition of the ship to be similar for both the LIN and LNG voyages. Further, the subdivision allows the simultaneous loading and discharge of the two cargoes to optimize the time spent in port at the first and second locations. Another advantage is that the ship may operate on a range of fuels, similar to known LNG carriers, and may include clean burning diesel as part of the LNG load to meet the power needs on the ship during transit and in port. Still another advantage is that the disclosed tank arrangement permits a LNG/LIN carrier to have access to ports in a manner similar to conventional LNG carriers. The subdivision and plurality of tanks disclosed herein ensure stability and ease of operation in loading and unloading LIN and LNG.

The use of LIN in the LNG liquefaction process as disclosed herein provides additional benefits. For example, LIN may be used to liquefy LNG boil off gas from the LNG-only cryogenic tank 102 and/or the first and second dual-purpose tanks 104, 106 during LNG production, transport and/or offloading.

Additionally, the disclosed aspects have the additional advantage of allowing for fast startup and reduced thermal cycling since a fraction of the stored liquid nitrogen can be used to keep the LNG-only cryogenic tank cold during periods when no LNG is stored therein.

Aspects of the disclosure may include any combinations of the methods and systems shown in the following numbered paragraphs. This is not to be considered a complete listing of all possible aspects, as any number of variations can be envisioned from the description above.

1. A water-borne carrier for transporting liquefied natural gas (LNG) and liquefied nitrogen (LIN), comprising a plurality of dual-purpose cryogenic storage tanks arranged along a length of the ship, the plurality of dual-purpose cryogenic storage tanks configured to contain LNG or LIN therein.

2. The water-borne carrier of paragraph 1, further comprising a LNG-only cryogenic storage tank arranged along the length of the ship, the LNG-only cryogenic storage tank configured to contain only LNG therein.

3. The water-borne carrier of paragraph 2, wherein the plurality of dual-purpose cryogenic storage tanks are arranged on either side of the LNG-only cryogenic storage tank.

4. The water-borne carrier of any of paragraphs 1-3, wherein each of the plurality of dual-purpose cryogenic storage tanks are subdivided transversely.

5. The water-borne carrier of any of paragraphs 2-4, wherein the LNG-only cryogenic storage tank is subdivided transversely.

6. The water-borne carrier of any of paragraphs 2-5, further comprising longitudinal subdividers in at least one of the plurality of dual-purpose cryogenic storage tanks and the LNG-only cryogenic storage tank.

7. The water-borne carrier of any of paragraphs 2-6, further comprising a ballast system configured to:

add ballast to the carrier as the plurality of dual-purpose cryogenic storage tanks are being emptied of LIN at a first location, and eject the water ballast from the carrier as the plurality of dual-purpose cryogenic storage tanks and the LNG-only cryogenic storage tank are being filled with LNG at the first location.

8. The water-borne carrier of any of paragraphs 1-7, further comprising:

a propulsion system configured to be fueled from LNG contained in at least one of the plurality of dual-purpose cryogenic storage tanks and the LNG-only cryogenic storage tank.

9. The water-borne carrier of any of paragraphs 1-8, further comprising an LNG-only cryogenic fuel tank configured to hold LNG for ship propulsion.

10. The water-borne carrier of any of paragraphs 1-9, further comprising a liquefaction module disposed onboard the water-borne carrier, the liquefaction module configured to liquefy a natural gas stream received at a first location using LIN contained in at least one of the plurality of dual-use cryogenic storage tanks.

11. A method of transporting liquefied natural gas (LNG) and liquefied nitrogen (LIN) in a water-borne carrier, comprising:

at a first location, emptying LIN from a plurality of dual-purpose cryogenic storage tanks that are positioned along a length of the carrier;

at the first location, filling the plurality of dual-purpose cryogenic storage tanks and an additional cryogenic storage tank with LNG, the additional cryogenic storage tank being positioned along the length of the carrier parallel to the plurality of dual-purpose cryogenic storage tanks;

using the carrier, transporting the LNG to a second location;

at the second location, emptying the LNG from the plurality of dual-purpose cryogenic storage tanks and the additional cryogenic storage tank;

at the second location, filling the plurality of dual-purpose cryogenic storage tanks with LIN; and using the carrier, transporting the LIN to the first location.

12. The method of paragraph 11, wherein the additional cryogenic storage tank is an LNG-only cryogenic storage tank, and wherein no LIN is placed in the LNG-only cryogenic storage tank.

13. The method of paragraph 11 or paragraph 12, wherein the first location is adjacent an LNG liquefaction facility.

14. The method of any of paragraphs 11-13, wherein the second location is adjacent at least one of an LNG regasification facility and a LIN production facility.

15. The method of any of paragraphs 11-14, wherein the plurality of dual-purpose cryogenic storage tanks are arranged in two or more rows along the length of the carrier.

16. The method of paragraph 15, wherein the additional cryogenic storage tank is arranged between the two or more rows along the length of the carrier.

17. The method of any of paragraphs 12-16, further comprising:

at the second location, emptying the plurality of dual-purpose cryogenic storage tanks of LNG before emptying LNG from the LNG-only cryogenic storage tank; and at the second location, filling the plurality of dual-purpose cryogenic storage tanks with LIN while emptying LNG from the LNG-only cryogenic storage tank.

18. The method of any of paragraphs 12-17, further comprising:

at the first location, filling the LNG-only cryogenic storage tank with LNG while emptying LIN from the plurality of dual-purpose cryogenic storage tanks.

19. The method of any of paragraphs 12-18, further comprising:

at the first location and/or the second location, maintaining a load balance of the carrier while emptying and filling the plurality of dual-purpose cryogenic storage tanks and the LNG-only cryogenic storage tank.

20. The method of any of paragraphs 12-19, further comprising:

adding water ballast to the carrier as the plurality of dual-purpose cryogenic storage tanks are being emptied of LIN at the first location; and ejecting the water ballast from the carrier as the plurality of dual-purpose cryogenic storage tanks and the LNG-only cryogenic storage tank are being filled with LNG at the first location.

21. The method of any of paragraphs 12-20, wherein emptying LNG from the LNG-only cryogenic storage tank comprises maintaining a carrier fuel allowance of LNG in the LNG-only cryogenic storage tank.

22. The method of any of paragraphs 12-21, wherein emptying LNG from the LNG-only cryogenic storage tank comprises maintaining a carrier fuel allowance of LNG in a LNG-only cryogenic fuel tank.

23. The method of any of paragraphs 12-22, further comprising:

maintaining the plurality of dual-purpose cryogenic storage tanks at or below a LIN liquefaction temperature when LIN is stored therein; and maintaining the plurality of dual-purpose cryogenic storage tanks at or below a LNG liquefaction temperature, but not below the LIN liquefaction temperature, when LNG is stored therein.

24. The method of any of paragraphs 12-23, further comprising:

maintaining the LNG-only cryogenic storage tank at or below a LNG liquefaction temperature, but not below the LIN liquefaction temperature, when LNG is stored therein.

25. The method of any of paragraphs 11-24, further comprising:

liquefying, onboard the water-borne carrier, a natural gas stream received at the first location using LIN emptied from at least one of the plurality of dual-use cryogenic storage tanks;

wherein the liquefying step produces the LNG that fills at least one of the plurality of dual-purpose cryogenic storage tanks and the additional cryogenic storage tank at the first location.

26. A method of transporting liquefied natural gas (LNG) and liquefied nitrogen (LIN) in a water-borne carrier, comprising:

at a first location, emptying LIN from a plurality of dual-purpose cryogenic storage tanks that are positioned along a length of the carrier;

at the first location, filling the plurality of dual-purpose cryogenic storage tanks and a LNG-only cryogenic storage tank with LNG, the LNG-only cryogenic storage tank being positioned along the length of the carrier between the plurality of dual-purpose cryogenic storage tanks;

using the carrier, transporting the LNG to a second location;

at the second location, emptying the LNG from the plurality of dual-purpose cryogenic storage tanks and the LNG-only cryogenic storage tank;

at the second location, filling the plurality of dual-purpose cryogenic storage tanks with LIN;

using the carrier, transporting the LIN to the first location;

at the first location and/or the second location, maintaining a load balance of the carrier while emptying and filling the plurality of dual-purpose cryogenic storage tanks and the LNG-only cryogenic storage tank;

wherein the plurality of dual-purpose cryogenic storage tanks are emptied of LNG before emptying LNG from the LNG-only cryogenic storage tank at the second location;

wherein the plurality of dual-purpose cryogenic storage tanks are filled with LIN while emptying LNG from the LNG-only cryogenic storage tank at the second location; and wherein the LNG-only cryogenic storage tank is filled with LNG while emptying LIN from the plurality of dual-purpose cryogenic storage tanks at the first location.

27. The method of paragraph 26, further comprising:

liquefying, onboard the water-borne carrier, a natural gas stream received at the first location using the LIN emptied from at least one of the plurality of dual-use cryogenic storage tanks;

wherein the liquefying step produces the LNG that fills at least one of the plurality of dual-purpose cryogenic storage tanks and the LNG-only cryogenic storage tank at the first location.

It should be understood that the numerous changes, modifications, and alternatives to the preceding disclosure can be made without departing from the scope of the disclosure. The preceding description, therefore, is not meant to limit the scope of the disclosure. Rather, the scope of the disclosure is to be determined only by the appended claims and their equivalents. It is also contemplated that structures and features in the present examples can be altered, rearranged, substituted, deleted, duplicated, combined, or added to each other.

What is claimed is:

1. A water-borne carrier for transporting liquefied natural gas (LNG) and liquefied nitrogen (LIN), comprising:

a plurality of dual-purpose cryogenic storage tanks arranged in two or more rows along a length of the carrier, the plurality of dual-purpose cryogenic storage tanks configured to contain LNG or LIN therein; and a LNG-only cryogenic storage tank arranged along the length of the carrier, the LNG-only cryogenic storage tank configured to contain only LNG therein, wherein the plurality of dual-purpose cryogenic storage tanks are arranged on either side of the LNG-only cryogenic storage tanks.

2. The water-borne carrier of claim 1, wherein each of the plurality of dual-purpose cryogenic storage tanks are subdivided transversely.

3. The water-borne carrier of claim 1, wherein the LNG-only cryogenic storage tank is subdivided transversely.

4. The water-borne carrier of claim 1, further comprising longitudinal subdividers in at least one of the plurality of dual-purpose cryogenic storage tanks and the LNG-only cryogenic storage tank.

5. The water-borne carrier of claim 1, further comprising a ballast system configured to:

add ballast to the carrier as the plurality of dual-purpose cryogenic storage tanks are being emptied of LIN at a first location, and eject the water ballast from the carrier as the plurality of dual-purpose cryogenic storage tanks and the LNG-only cryogenic storage tank are being filled with LNG at the first location.

6. The water-borne carrier of claim 1, further comprising:

a propulsion system configured to be fueled from LNG contained in at least one of the plurality of dual-purpose cryogenic storage tanks and the LNG-only cryogenic storage tank.

7. The water-borne carrier of claim 1, wherein the LNG-only cryogenic fuel tank is configured to hold LNG for ship propulsion.

8. The water-borne carrier of claim 1, further comprising a liquefaction module disposed onboard the water-borne carrier, the liquefaction module configured to liquefy a natural gas stream received at a first location using LIN contained in at least one of the plurality of dual-use cryogenic storage tanks.

9. A method of transporting liquefied natural gas (LNG) and liquefied nitrogen (LIN) in a water-borne carrier, comprising:

at a first location, emptying LIN from a plurality of dual-purpose cryogenic storage tanks that are positioned along a length of the carrier, wherein the plurality of dual-purpose cryogenic storage tanks are arranged in two or more rows along the length of the carrier;

at the first location, filling the plurality of dual-purpose cryogenic storage tanks and an additional cryogenic storage tank with LNG, the additional cryogenic storage tank being positioned along the length of the carrier parallel to the plurality of dual-purpose cryogenic storage tanks, the additional cryogenic storage tank being arranged between the two or more rows along the length of the carrier;

using the carrier, transporting the LNG to a second location;

at the second location, emptying the LNG from the plurality of dual-purpose cryogenic storage tanks and the additional cryogenic storage tank;

at the second location, filling the plurality of dual-purpose cryogenic storage tanks with LIN; and using the carrier, transporting the LIN to the first location.

10. The method of claim 9, wherein the additional cryogenic storage tank is an LNG-only cryogenic storage tank, and wherein no LIN is placed in the LNG-only cryogenic storage tank.

11. The method of claim 9, wherein the first location is adjacent an LNG liquefaction facility.

12. The method of claim 9, wherein the second location is adjacent at least one of an LNG regasification facility and a LIN production facility.

13. The method of claim 10, further comprising:

at the second location, emptying the plurality of dual-purpose cryogenic storage tanks of LNG before emptying LNG from the LNG-only cryogenic storage tank; and at the second location, filling the plurality of dual-purpose cryogenic storage tanks with LIN while emptying LNG from the LNG-only cryogenic storage tank.

14. The method of claim 10, further comprising:

at the first location, filling the LNG-only cryogenic storage tank with LNG while emptying LIN from the plurality of dual-purpose cryogenic storage tanks.

15. The method of claim 10, further comprising:

at the first location and/or the second location, maintaining a load balance of the carrier while emptying and filling the plurality of dual-purpose cryogenic storage tanks and the LNG-only cryogenic storage tank.

16. The method of claim 10, further comprising:

adding water ballast to the carrier as the plurality of dual-purpose cryogenic storage tanks are being emptied of LIN at the first location; and ejecting the water ballast from the carrier as the plurality of dual-purpose cryogenic storage tanks and the LNG-only cryogenic storage tank are being filled with LNG at the first location.

17. The method of claim 10, wherein emptying LNG from the LNG-only cryogenic storage tank comprises maintaining a carrier fuel allowance of LNG in the LNG-only cryogenic storage tank.

18. The method of claim 10, wherein emptying LNG from the LNG-only cryogenic storage tank comprises maintaining a carrier fuel allowance of LNG in a LNG-only cryogenic fuel tank.

19. The method of claim 10, further comprising:

maintaining the plurality of dual-purpose cryogenic storage tanks at or below a LIN liquefaction temperature when LIN is stored therein; and maintaining the plurality of dual-purpose cryogenic storage tanks at or below a LNG liquefaction temperature, but not below the LIN liquefaction temperature, when LNG is stored therein.

20. The method of claim 10, further comprising:

maintaining the LNG-only cryogenic storage tank at or below a LNG liquefaction temperature, but not below the LIN liquefaction temperature, when LNG is stored therein.

21. The method of claim 9, further comprising:

liquefying, onboard the water-borne carrier, a natural gas stream received at the first location using LIN emptied from at least one of the plurality of dual-use cryogenic storage tanks;

wherein the liquefying step produces the LNG that fills at least one of the plurality of dual-purpose cryogenic storage tanks and the additional cryogenic storage tank at the first location.

22. A method of transporting liquefied natural gas (LNG) and liquefied nitrogen (LIN) in a water-borne carrier, comprising:

at a first location, emptying LIN from a plurality of dual-purpose cryogenic storage tanks that are positioned along a length of the carrier;

at the first location, filling the plurality of dual-purpose cryogenic storage tanks and a LNG-only cryogenic storage tank with LNG, the LNG-only cryogenic storage tank being positioned along the length of the carrier between the plurality of dual-purpose cryogenic storage tanks;

using the carrier, transporting the LNG to a second location;

at the second location, emptying the LNG from the plurality of dual-purpose cryogenic storage tanks and the LNG-only cryogenic storage tank;

at the second location, filling the plurality of dual-purpose cryogenic storage tanks with LIN;

using the carrier, transporting the LIN to the first location; and at the first location and/or the second location, maintaining a load balance of the carrier while emptying and filling the plurality of dual-purpose cryogenic storage tanks and the LNG-only cryogenic storage tank;

wherein the plurality of dual-purpose cryogenic storage tanks are emptied of LNG before emptying LNG from the LNG-only cryogenic storage tank at the second location;

wherein the plurality of dual-purpose cryogenic storage tanks are filled with LIN while emptying LNG from the LNG-only cryogenic storage tank at the second location; and wherein the LNG-only cryogenic storage tank is filled with LNG while emptying LIN from the plurality of dual-purpose cryogenic storage tanks at the first location.

23. The method of claim 22, further comprising:

liquefying, onboard the water-borne carrier, a natural gas stream received at the first location using the LIN emptied from at least one of the plurality of dual-use cryogenic storage tanks;

wherein the liquefying step produces the LNG that fills at least one of the plurality of dual-purpose cryogenic storage tanks and the LNG-only cryogenic storage tank at the first location.

* * * * *